US005540625A

United States Patent [19]

Koch et al.

[11] Patent Number: 5,540,625

[45] Date of Patent: Jul. 30, 1996

[54] PNEUMATICALLY ENHANCED GOLF CLUBS

[76] Inventors: John A. Koch; Louise Koch, both of P.O. Box 5095, 1011 Troon Dr. East, Niceville, Fla. 32578

[21] Appl. No.: 508,352

[22] Filed: Jul. 27, 1995

[51] Int. Cl.[6] ..... A63B 53/08

[52] U.S. Cl. ..... 473/318; 473/332

[58] Field of Search ..... 273/170, 171, 273/80 R, 81 B, 80 B, 80 A, 81 R, 77 R, 77 A, 167 R; 473/318, 332

[56] References Cited

U.S. PATENT DOCUMENTS

| | | | |
|---|---|---|---|
| 1,831,255 | 11/1931 | Menzies | 273/81 R |
| 1,894,841 | 1/1933 | Adams | 273/170 |
| 2,124,534 | 7/1938 | Barnhart | 273/170 |
| 2,432,450 | 12/1947 | Sears | 273/170 |
| 3,993,314 | 11/1976 | Harrington | 273/170 |
| 5,082,279 | 1/1992 | Hull | 273/170 |

*Primary Examiner*—Sebastiano Passaniti
*Attorney, Agent, or Firm*—George A. Bode

[57] ABSTRACT

A golf club having shafts and club heads comprised of either: metals, composites, or ceramics which are gas permeable and possess the properties of hollows and cavities respectively. Whereas upon sealing the union of the shaft and the club head renders same air tight. Further, introducing a gas induction valve at the shafts upper end thereby enabling gas induction while also providing a check valve seal to prohibit gas loss after pressurization provides a hermetically sealed golf club. This art applies to any provider of golf club components meeting these generic requirements. Whereas the compilation of components aforementioned while inducing compressed gas dependent upon the type golf club, will enhance the performance of any golf club so modified.

19 Claims, 1 Drawing Sheet

PNEUMATICALLY ENHANCED GOLF CLUBS

BACKGROUND-FIELD OF INVENTION

This invention relates to a golf club assemblage of a hollow shaft fitted with a gas check valve at it's upper end, and a club head having a cavity joined and pneumatically sealed, for the purpose of pressurizing 100% of a golf club embodiment.

BACKGROUND-DESCRIPTION OF PRIOR ART

Normally other inventions of this nature, provide hollow shafts connected by means of insertion of the shaft into skeletal club heads having a cavity providing the complete art of the most widely used golf clubs. Prior art cited does not encompass a shaft and club head as a unified embodiment hermetically sealed and pressurized.

An example of prior art illustrated in U.S. Pat. No. 5,316,300 issued to Simmons. This patent describes a golf clubs composite shaft whereas a high viscosity fluid is selectively placed in a predetermined location. This patent claims high viscosity fluid minimizes deformation of the shaft under load and controls the natural vibration frequency of the shaft. This patent however, does not communicate high viscosity fluid to the club head thereby does not pressurize the club head and only a portion of the shaft.

This present invention relates to a golf club and more particularly to a golf club having a hollow conical shaft. Connected to shafts lower end a head or striking component having a cavity therein generally referred to as a club head. Located at the shafts it's upper end a grip which is wrapped or fitted over the shaft. The invention consists of joining the hollow shaft at the lower end to the club head having a cavity. This union having an axial passage in which to communicate gas bilaterally when joined. The joining of the shaft and the club head is in such a manner so as to seal any gases that may be applied under pressure from escaping. Further the invention consists of inserting a pneumatic check valve in the upper end of the hollow conical shaft hermetically sealing the shaft and club head allowing discharged gas under pressure to flow through gas check valve forming a sealing relationship therein preventing the loss of gas under pressure.

OBJECTS AND ADVANTAGES

The invention when properly assembled and sealed allows discharged gas under pressure to flow through gas check valve pressurizing the shaft while communicating gas to the second chamber termed the club head cavity through an axial passage between the lower shaft and club head. Pressurization of the embodiment straightens the shaft and grows the club head making each more rigid.

(a) The object of this invention is to provide new and novel means for a golf club to make the shaft straighter and more rigid and the club head surfaces of equal pressure.

(b) Upon the making of a union of the shaft and the club head of an gas tight fashion comprises a single embodiment having an axial passage for bilaterally communicating gas. This embodiment having an axial passage for bilaterally communicating gas from the shaft to the second chamber termed the club head cavity exist under equal pressure.

(c) Inducing compressed gas into the pneumatic check valve located at the upper end of the shaft compresses shafts conical, tubular passage to and including the club head cavity 100% axially.

(d) It is therefore an object of this invention to provide a pressurized shaft to minimize flex encountered on the clubs approach to striking the object golf ball.

(e) It is a further object of this invention to minimize inaccuracies in the stroke of a golf ball due to distortion of the shaft on impact of the club with the ball.

(f) It is a further object of this invention to increase the striking force of a golf ball by reinforcing the club head generally termed in golfing, the sweet spot. The sweet spot, located on the face of the club head allows for all combined surfaces of the internally pressurized club head to unilaterally stabilize and reinforce the club heads sweet spot, thus in theory providing greater distance.

DRAWING FIGURES

REFERENCED NUMERALS IN DRAWINGS

Figure 1:
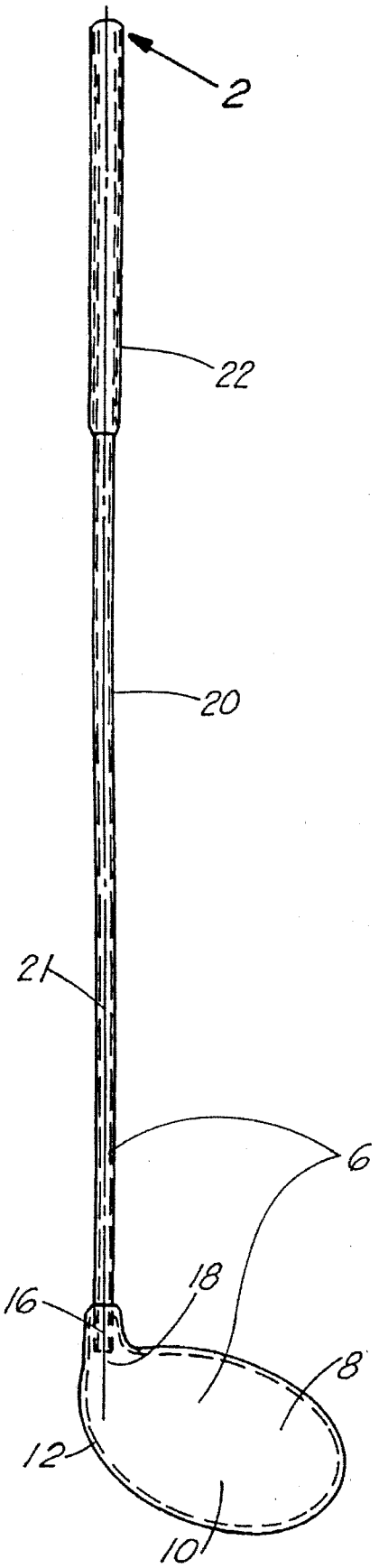
FIG. 1, is an isometric view of a preferred embodiment of the invention.

06. Pressurized gas
08. Club head cavity
10. Club head face
12. Club head
16. Axial passage
18. Axial club head cavity
20. Shaft
21. Shaft axial cavity
22. Grip
27. Gas induction cavity
28. Valve embodiment
29. Valve embodiment axial cavity
30. O ring seal
31. Valve embodiment O ring seat
32. Valve embodiment male threads
33. Valve embodiment cavity female threads
34. Rubber gas seal
36. Threaded valve seat
38. Shaft O ring seat
42. Valve embodiment receiving threads

DESCRIPTION - FIGS. 1, 2

Referring to the drawings and particularly FIG. 1, a preferred embodiment of the invention, mainly comprises a pneumatic check valve Compilation consisting of grip 22, and valve embodiment 28, at it's upper end, with a conical tubular member, the shaft 20, and a club head 12, at it's lower end.

Figure 2:
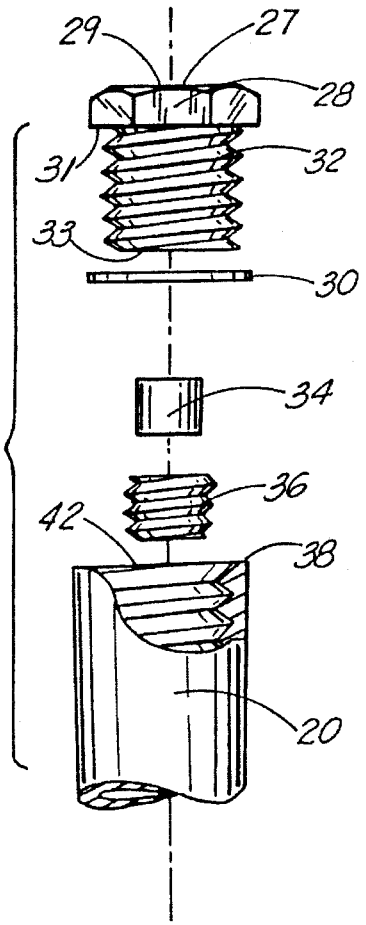
FIG. 2, is an isometric exploded view of pneumatic check valve compilation.

Referring to FIG. 2, a preferred embodiment of the exploded view of pneumatic check valve compilation mainly comprises a valve embodiment 28, having a gas induction cavity 27, in the axial plane of valve embodiment 28, and O ring seal 30, seated flush to valve embodiment O ring seat 31, whereas valve embodiment 28, having valve embodiment male threads 32, and valve embodiment 28, with valve cavity embodiment female threads 33, whereas rubber gas seal 34, is inserted into valve embodiment axial cavity 29, whereas gas seal 34, of a rubber compound, or elastic plastic, such as polysiloxane, possessing such properties that upon removal of such device that may be used to induce gas becomes self sealing upon installation of threaded valve seat 36, which is pirouetted into valve cavity embodiment female threads 33, thus compressing rubber gas seal 34, whereupon, removal of gas injection device the compound under pressure compressing the compound provides a positive gas seal. The valve embodiment 28, with O ring seal 30, assembled with compressed rubber gas seal 34, and threaded valve seat 36, is pirouetted into valve embodiment receiving threads 42, providing a positive gas valve seal.

Referring to FIG. 1, isometric view of the invention, whereas the embodiment of FIG. 2, located at the upper end of shaft 20, whereupon applying the proper epoxy adhesives to axial club head cavity prior insertion of shaft 20, into axial club head cavity 18, and upon curing makes a air tight union with club head 12, forming a gas permeable axial seal allowing the shaft 20, and the club head 12, to communicate pressurized gas when introduced under pressure through gas induction cavity 27, by what is typically referred to as a sports needle inflation valve stem.

OPERATIONS-FIGS. 1, 2

Referring to the drawings and particularly FIG. 2, (isometric view) constitutes a pneumatic check valve located at the upper end of shaft whereupon introduction of compressed gas is retained by said valve. The embodiment thereof illustrated in FIG. 1, constituting a seal at the upper shaft 20, the shaft 20, and the club head 12, joined and rendered air tight with an axial passage 16, communicating compressed gas bilaterally from shaft 20, to club head 12, forms a hermetically sealed shaft and club head.

SUMMARY, RAMIFICATIONS AND SCOPE

Accordingly, the reader will understand a pneumatically enhanced golf club provides the golfer a golf club assemblage in which the shaft travels in a more adamantine tangent from fulcrum thus the golf club head arrives at the object golf ball in a more controlled arc, at an elevated velocity, whereas combined with reduced concavity of the club head or sweet spot, produces a greater concussion at point of contact resulting in increased driving distances. A gas pressurized golf club dictates various ranges of pressure dependent upon the type of golf club this art, is applied. Increased shaft rigidity and reduced shaft flex including outward pressure on all surfaces of the club head cavity precipitate when pressurized.

Using a benchmark of existing art of non pressurized golf clubs inherently produces a certain amount of flex and club head concavity. The same art pressurized results in reduced shaft flex resulting in the club head arriving at the ball at a heightened rate of travel and betimes that of an nonpressurized golf club. Nonpressurized golf clubs result in heightened shaft flex arriving milliseconds belatedly as a direct result of shaft flex. Demonstrated by observing the tangent from a fulcrum being curved, or retarded as much as one to several degrees, opposed to a more rigid shaft maintaining a more inelastic line on tangent from the same fulcrum.

- A pressurized shaft maintains a more inelastic line resulting in a pronounced abutment with the ball.
- This art further suggests a pressurized golf club head cavity reinforces all facets of the club heads interior surfaces and unilaterally stabilizes and reinforces the club heads abutting face.
- A unilaterally stabilized club head provides for less concavity to the club head face. Upon impact with a golf ball reduced face concavity exacerbates the driving force.
- A golf club hermetically sealed and pressurized by gas to a degree determined by the golfers playing preference.
- A gas pressurized golf club may consist of various ranges of pressure dependent upon the type of golf club this art is applied.
- The degree of pressurization applied will have a direct bearing on the performance, whereas a golfer may be desirous of increasing or decreasing gas pressure and may adjust the pressure to accommodate individual play.
- Accordingly, several objects and advantages of my invention are that a golf club enhanced pneumatically by means of compressed gas reduces shaft flex, and unilaterally stabilizes and reinforces the club head.
- Thus in effect the practical application a more rigid shaft as a result of gas pressure and a club head with a more rigid sweet spot with less concavity will achieve greater driving distances than a clone of the same golf club assembled without being stabilized or made more adamantine with the deficiency of pressurization by gas.

We claim:

1. A golf club comprising:

(a) a club head having an abutting external face and a cavity therein;

(b) a hollow, elongated tubular shaft, thereby forming an axial passageway therethrough, said passageway being in fluid communication with said cavity, said hollow shaft and cavity being sealed; and, (c) means for allowing the input of a fluid under a pressure greater than atmospheric pressure into said shaft and cavity, but preventing the discharge of said fluid under pressure therefrom, said fluid under pressure thereby straightening said shaft and adding rigidity to said shaft and club head.

2. The apparatus of claim 1, wherein said shaft has a first or upper end portion and a second or lower end portion, said means for allowing and preventing being provided in said first end portion of said shaft.

3. The apparatus of claim 1, wherein said passageway and said cavity are connected at the second end portion of said shaft.

4. The apparatus of claim 1, wherein said elongated shaft is conical therealong.

5. The apparatus of claim 1, further comprising gripping means circumferentially provided on an exterior surface of said first end portion of said shaft.

6. The apparatus of claim 1, wherein said fluid under pressure is a compressed gas.

7. The apparatus of claim 1, wherein said means for allowing and preventing is a valve means further comprising:

(a) a valve body having a fluid induction bore axially therethrough;

(b) means seated in an annular seat about said valve body for sealably engaging said first end portion of said shaft.

8. A golf club comprising:

(a) a club head having an abutting external face and a cavity therein;

(b) a hollow, elongated tubular shaft, thereby forming an axial passageway therealong, said shaft having a first or upper end portion and a second or lower end portion, said passageway being in fluid communication with said cavity, said hollow shaft and cavity being sealed; and, (c) valve means for allowing the input of a fluid under a pressure greater than atmospheric pressure into said shaft and cavity, but preventing the discharge of said fluid under pressure therefrom, said means being provided in said first end of said shaft, said fluid under pressure thereby straightening said shaft and adding rigidity to said shaft and club head.

9. The apparatus of claim 8, wherein said passageway and said cavity are connected at the second end portion of said shaft.

10. The apparatus of claim 8, wherein said elongated shaft is conical therealong.

11. The apparatus of claim 8, further comprising gripping means circumferentially provided on an exterior surface of said first end portion of said shaft.

12. The apparatus of claim 8, wherein said fluid under pressure is a compressed gas.

13. The apparatus of claim 8, wherein said valve means for allowing and preventing is a check valve further comprising:

(a) a valve body having a fluid induction bore axially therethrough;

(b) seal means seated in an annular seat about said valve body for engaging said first end portion of said shaft and threads provided about said valve body for engaging mating threads in said first end portion of said shaft.

14. A golf club comprising:

(a) a club head having an abutting external face and a cavity therein;

(b) a hollow, elongated tubular shaft, thereby forming an axial passageway therealong, said shaft having a first or upper end portion and a second or lower end portion, said passageway being in fluid communication with said cavity, said hollow shaft and cavity being sealed; and, (c) valve means for allowing the input of a fluid under a pressure greater than atmospheric pressure into said shaft and cavity, but preventing the discharge of said fluid under pressure therefrom, said means being provided in said first end of said shaft, said fluid under pressure thereby straightening said shaft and adding rigidity to said shaft and club head, thereby providing the club head a more direct and accurate on tangent approach to an object golf ball and thus allowing less concavity to the club head face upon impact with a golf ball.

15. The apparatus of claim 14, wherein said passageway and said cavity are connected at the second end portion of said shaft.

16. The apparatus of claim 14, wherein said elongated shaft is conical therealong.

17. The apparatus of claim 14, further comprising gripping means circumferentially provided on an exterior surface of said first end portion of said shaft.

18. The apparatus of claim 14, wherein said fluid under pressure is a compressed gas.

19. The apparatus of claim 14, wherein said valve means for allowing and preventing is a pneumatic induction check valve further comprising:

(a) a valve body having a fluid induction bore axially therethrough;

(b) an O-ring seal seated in an annular seat on said valve body for engaging said first end portion of said shaft and threads provided about said valve body for sealably engaging mating threads in said first end portion of said hollow shaft.

* * * * *